US009016849B2

(12) United States Patent
Fujisawa et al.

(10) Patent No.: US 9,016,849 B2
(45) **Date of Patent: *Apr. 28, 2015**

(54) ELECTROMAGNETIC WAVE IRRADIATION DEVICE AND IMAGE FORMATION APPARATUS

(71) Applicant: Seiko Epson Corporation, Tokyo (JP)

(72) Inventors: Kazutoshi Fujisawa, Okaya (JP); Yoshimitsu Hayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/089,568

(22) Filed: Nov. 25, 2013

(65) Prior Publication Data

US 2014/0078230 A1 Mar. 20, 2014

Related U.S. Application Data

(63) Continuation of application No. 13/361,494, filed on Jan. 30, 2012, now Pat. No. 8,616,697.

(30) Foreign Application Priority Data

Feb. 1, 2011 (JP) ..... 2011-019528

(51) Int. Cl.
*B41J 11/00* (2006.01)

(52) U.S. Cl.
CPC ..... *B41J 11/002* (2013.01)

(58) Field of Classification Search
USPC ..... 347/100–102
See application file for complete search history.

(56) References Cited

U.S. PATENT DOCUMENTS 6,834,948 B2 12/2004 Asano et al.

(Continued)

FOREIGN PATENT DOCUMENTS

| | | | |
|---|---|---|---|
| JP | 2002-292907 | A | 10/2002 |
| JP | 2004-249617 | A | 9/2004 |
| JP | 2004-358931 | A | 12/2004 |
| JP | 2005-329584 | A | 12/2005 |

(Continued)

OTHER PUBLICATIONS

Extended European Search Report dated May 30, 2012 as received in application No. 12 153 035.6.

*Primary Examiner* — Julian Huffman
*Assistant Examiner* — Sharon A Polk
(74) *Attorney, Agent, or Firm* — Maschoff Brennan

(57) ABSTRACT

An electromagnetic wave irradiation device includes an irradiator which irradiates electromagnetic waves onto a liquid droplet which has been adhered to a recording medium, an irradiation controller which causes the irradiator to irradiate the electromagnetic waves periodically such that a frequency of an irradiation period in which the electromagnetic waves are irradiated is a predetermined frequency, and a time setting unit which sets a time ratio obtained by dividing a length of an irradiation time by the irradiator in the irradiation period by a length of a termination time during which the electromagnetic waves are not irradiated by the irradiator in the irradiation period to be a value of greater than or equal to 0.2 and less than or equal to 2.

10 Claims, 6 Drawing Sheets

(56) References Cited

U.S. PATENT DOCUMENTS

| | | | | |
|---|---|---|---|---|
| 7,642,527 | B2 | 1/2010 | Marson et al. | |
| 8,616,697 | B2 * | 12/2013 | Fujisawa et al. | 347/102 |
| 2009/0225143 | A1 | 9/2009 | Fukui | |
| 2009/0280302 | A1 | 11/2009 | Fukumoto et al. | |
| 2012/0194623 | A1 * | 8/2012 | Fujisawa et al. | 347/102 |

FOREIGN PATENT DOCUMENTS

| | | | |
|---|---|---|---|
| JP | 2006-142613 | A | 6/2006 |
| JP | 2006-231795 | A | 9/2006 |
| JP | 2007-185852 | A | 7/2007 |
| JP | 2009-057548 | A | 3/2009 |
| WO | 2010/105365 | A1 | 9/2010 |

* cited by examiner

| | | GLOSS MODE | | SEMI-GLOSS MODE | | MATTE MODE | |
|---|---|---|---|---|---|---|---|
| USAGE OF CL | | AVAILABLE | UNAVAILABLE | AVAILABLE | UNAVAILABLE | AVAILABLE | UNAVAILABLE |
| W | R | INFINITE | INFINITE | INFINITE | INFINITE | INFINITE | INFINITE |
| | i | 0.5 | 0.5 | 0.5 | 0.5 | 0.5 | 0.5 |
| C | R | INFINITE | 1/3 | INFINITE | 2 | INFINITE | 1/3 |
| | i | 0.5 | 2.5 | 0.5 | 0.8 | 0.5 | 2.5 |
| M | R | INFINITE | 1/3 | INFINITE | 2 | INFINITE | 1/3 |
| | i | 0.5 | 2.5 | 0.5 | 0.8 | 0.5 | 2.5 |
| Y | R | INFINITE | 1/3 | INFINITE | 2 | INFINITE | 1/3 |
| | i | 0.5 | 2.5 | 0.5 | 0.8 | 0.5 | 2.5 |
| K | R | INFINITE | 1/3 | INFINITE | 2 | INFINITE | 1/3 |
| | i | 0.5 | 2.5 | 0.5 | 0.8 | 0.5 | 2.5 |
| CL | R | 1/3 | | 2 | | INFINITE | |
| | i | 2.5 | | 0.8 | | 0.5 | |

FIG. 3A

| $t_1:t_2$ | 1:0 (CONTINUOUS) | 3:1 | 2:1 | 1:1 | 1:2 | 1:3 | 1:4 | 1:5 | 1:6 |
|---|---|---|---|---|---|---|---|---|---|
| TIME RATIO | INFINITE | 3 | 2 | 1 | 1/2 | 1/3 | 1/4 | 1/5 | 1/6 |
| 7.5 $\mu$m | MATTE | MATTE | SEMI-GLOSS | GLOSS | GLOSS | GLOSS | GLOSS | GLOSS | CURING FAILURE |
| 12.5 $\mu$m | MATTE | MATTE | SEMI-GLOSS | SEMI-GLOSS | GLOSS | GLOSS | GLOSS | GLOSS | CURING FAILURE |
| 17.5 $\mu$m | MATTE | MATTE | MATTE | SEMI-GLOSS | SEMI-GLOSS | GLOSS | GLOSS | GLOSS | CURING FAILURE |

CL IS AVAILABLE
GLOSS MODE

CL IS AVAILABLE
SEMI-GLOSS MODE

CL IS AVAILABLE
MATTE MODE

CL IS UNAVAILABLE
GLOSS MODE

CL IS UNAVAILABLE
SEMI-GLOSS MODE

CL IS UNAVAILABLE
MATTE MODE

ELECTROMAGNETIC WAVE IRRADIATION DEVICE AND IMAGE FORMATION APPARATUS

CROSS REFERENCES TO RELATED APPLICATIONS

This application is a continuation of U.S. patent application Ser. No. 13/361,494, filed on Jan. 30, 2012, which claims priority to Japanese Patent Application No. 2011-019528 filed Feb. 1, 2011, both of which are expressly incorporated herein by reference.

BACKGROUND

1. Technical Field

The present invention relates to an electromagnetic wave irradiation device including an irradiator which irradiates electromagnetic waves onto a liquid droplet adhered to a recording medium and an image formation apparatus.

2. Related Art

A recording apparatus which controls a flashing light source to irradiate a flash of light onto light-curable ink has been proposed. One example is found in Japanese Patent Application No. JP-A-2006-142613. In this apparatus, because the ink is irradiated with the flash of light at least once, the ink can be reliably cured.

One problem with JP-A-2006-142613, however, is that while the ink can be reliably cured, high surface glossiness of the ink cannot be realized.

SUMMARY

An advantage of some aspects of the invention is to provide a technique of realizing high surface glossiness of a liquid droplet.

In an electromagnetic wave irradiation device according to an aspect of the invention, an irradiator irradiates electromagnetic waves onto a liquid droplet which has been adhered to a recording medium. An irradiation controller causes the irradiator to irradiate the electromagnetic waves periodically such that a frequency of an irradiation period in which the electromagnetic waves are irradiated by the irradiator is a predetermined frequency. A time setting unit sets a time ratio obtained by dividing a length of an irradiation time during which the electromagnetic waves are irradiated by the irradiator in the irradiation period by a length of a termination time during which the electromagnetic waves are not irradiated by the irradiator in the irradiation period to be a ≥0.2 and ≤ than 2. With this, high surface glossiness of a liquid droplet can be realized.

A surface of the liquid droplet is cured from one side in the time during which the electromagnetic waves are irradiated. This is because the electromagnetic waves decay in the depth direction of the ink droplet so that energy of the electromagnetic waves required for curing is applied one-sidedly to the surface. Accordingly, the surface of the liquid droplet can be accelerated to be cured in the time during which the electromagnetic waves are irradiated. On the other hand, since the surface of the liquid droplet is exposed to oxygen, curing of the surface of the liquid droplet is suppressed by oxygen inhibition. In particular, an inner portion of the liquid droplet on which curing is difficult to be suppressed with oxygen by the oxygen inhibition is cured from one side in the time during which the electromagnetic waves are not irradiated. That is to say, the irradiation time during which the electromagnetic waves are irradiated and the termination time during which the electromagnetic waves are not irradiated are provided so that the ink droplet can be progressively cured on the surface and the inner portion of the liquid droplet in a balanced manner. If the ink droplet is progressively cured on the surface and the inner portion in a balanced manner, contraction on the surface and the inner portion with the curing of the ink droplet can be made equivalent. Accordingly, problems where irregularities are formed on the surface due to deformation of the ink droplet and the surface glossiness is deteriorated can be prevented from occurring, thereby realizing high surface glossiness. If the time ratio obtained by dividing the length of the irradiation time by the length of the termination time is set to be a value of greater than or equal to 0.2 and less than or equal to 2, a ratio between a length of a time during which the surface of the liquid droplet is accelerated to be cured and a length of a time during which the inner portion of the liquid droplet is accelerated to be cured is appropriate, thereby realizing high surface glossiness of the liquid droplet.

It is to be noted that an effect of the invention can be obtained in a single electromagnetic wave irradiation device and can be also realized in a case where the electromagnetic wave irradiation device is assembled on another apparatus. For example, the electromagnetic wave irradiation device according to the aspect of the invention may be assembled on an image formation apparatus including a liquid droplet adhesion unit which makes a liquid droplet adhere to the recording medium.

BRIEF DESCRIPTION OF THE DRAWINGS

The invention will be described with reference to the accompanying drawings, wherein like numbers reference like elements.

FIG. 3A is a table illustrating a relationship between surface roughness and time ratio and FIGS. 3B to 3G are plan views schematically illustrating a printed material.

DESCRIPTION OF EXEMPLARY EMBODIMENTS

Figure 1A:
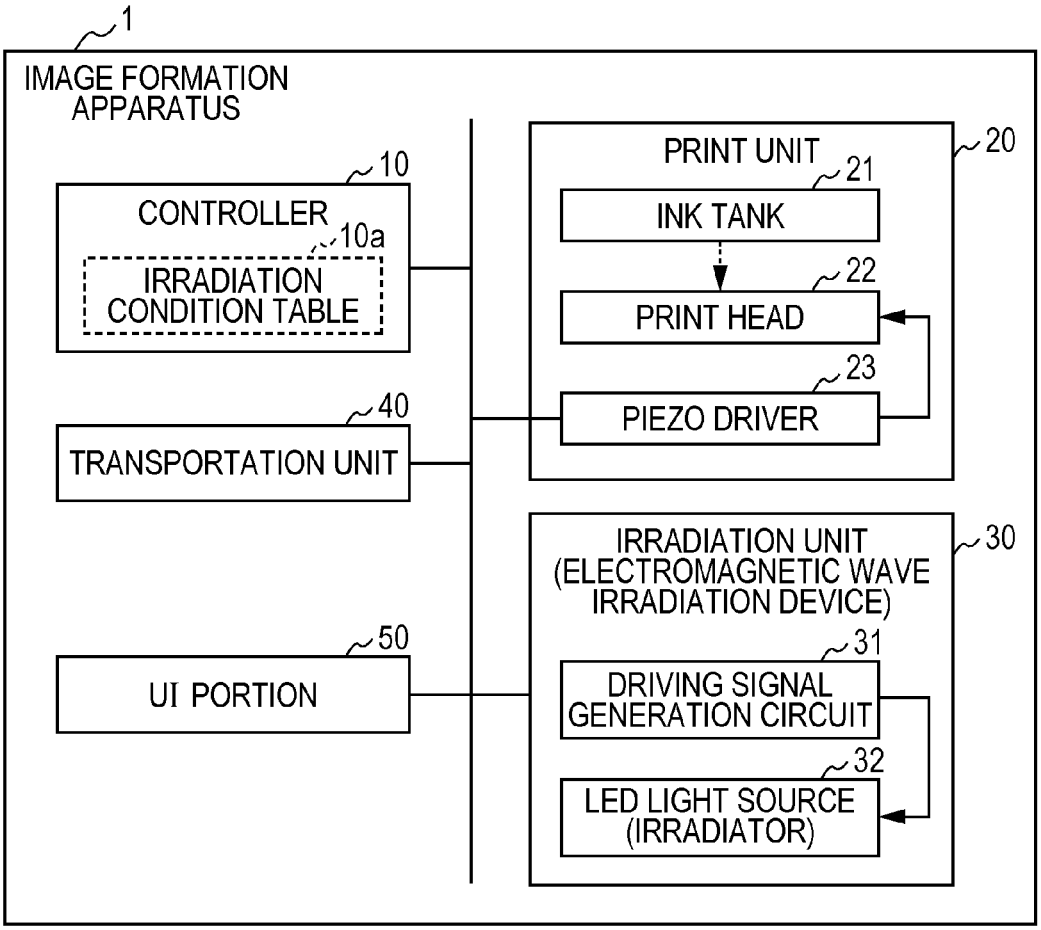
FIG. 1A is a block diagram illustrating an image formation apparatus.

Hereinafter, an embodiment of the invention is described with reference to accompanying drawings in the following order. It is to be noted that in the drawings, corresponding components are denoted with the same reference numerals and description thereof is not repeated.

1. Configuration of Image Formation Apparatus
2. Print Result
3. Variations

1. Configuration of Image Formation Apparatus

FIG. 1A is a block diagram illustrating an image formation apparatus 1 including an electromagnetic wave irradiation device according to an embodiment of the invention. The image formation apparatus 1 is a line type ink jet printer which forms a print image on a recording medium with ultraviolet curable ink. The image formation apparatus 1 includes a controller 10, a print unit 20, irradiation units 30, a transportation unit 40, and a UI (User Interface) portion 50. The controller 10 includes an ASIC, a CPU, a ROM, and a RAM (not illustrated). The ASIC and the CPU which executes programs recorded in the ROM execute various arithmetic processes for executing a print control process, described more fully below. In the embodiment, the recording medium is a transparent resin film.

The print unit 20 includes ink tanks 21, print heads 22, and piezoelectric drivers 23. The ink tanks 21 store inks to be supplied to the print heads 22. The ink tanks 21 in the embodiment store various inks of white (W), cyan (C), magenta (M), yellow (Y), black (K), and clear (CL (transparent)), respectively. Each ink is an ultraviolet curable ink and contains an ultraviolet polymerizable resin which receives energy of ultraviolet rays as electromagnetic waves to proceed in polymerization, a polymerization initiator, a colorant (excluding CL), and the like. The ink tanks 21 store ultraviolet curable inks as described in JP-A-2009-57548, for example.

Figure 1B:
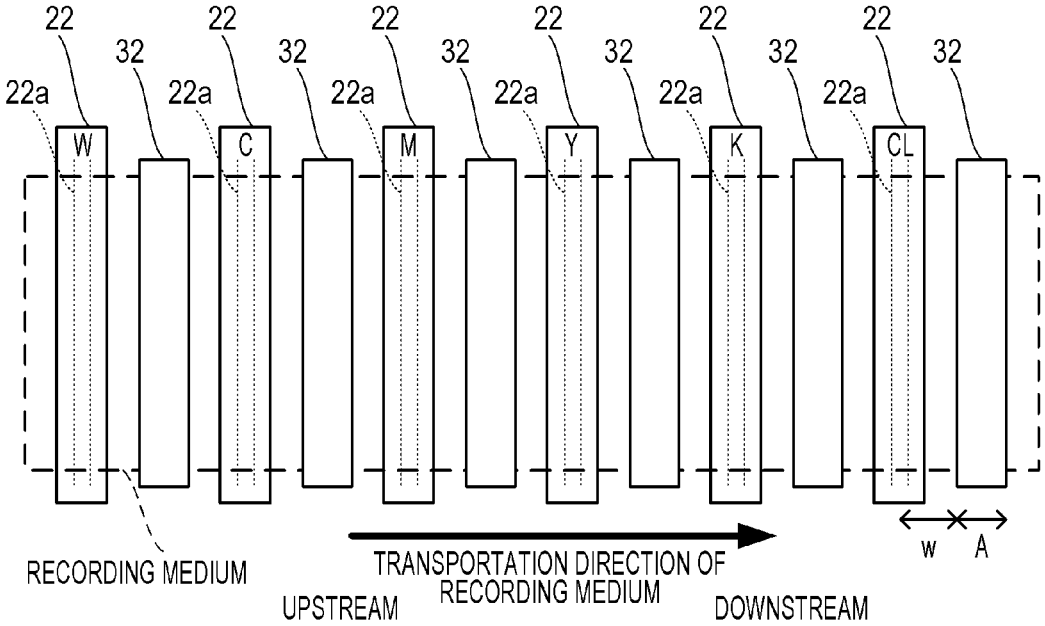
FIG. 1B is a bottom view illustrating the print heads of the image formation apparatus.

FIG. 1B is a bottom view illustrating the print heads 22 as seen from the side of the recording medium. A print head 22 is provided for each ink type. The print heads 22 are arranged in the order of W→C→M→Y→K→CL from an upstream side in a transportation direction of the recording medium (indicated by a dashed line). Each print head 22 has a nozzle face which is opposed to the recording medium and includes a plurality of nozzles 22*a* arranged on the nozzle face. The nozzles 22*a* are linearly arranged on the print heads 22 and arrangement direction of the nozzles 22*a* corresponds to a width direction of the recording medium (direction perpendicular to the transportation direction). Further, the nozzles 22*a* are arranged in a range wider than the width of the recording medium. The nozzles 22*a* communicate with ink chambers (not illustrated) and inks supplied from the ink tanks 21 are filled into the ink chambers. A piezoelectric element (not illustrated) is provided on the ink chamber for each nozzle 22*a* and a piezoelectric driver 23 applies a driving voltage pulse to the piezoelectric elements based on a control signal from the controller 10. If the driving voltage pulse is applied, the piezoelectric elements are mechanically deformed so that inks filled in the ink chambers are pressurized and decompressed. Using this means, ink droplets are discharged toward the recording medium through the nozzles 22*a*. The nozzles 22*a* are arranged in a range wider than the width of the recording medium. Therefore, ink droplets can be adhered to the entire range of the recording medium in the width direction. In the embodiment, an ink droplet is discharged by a weight c (for example, c=10 ng) per discharge such that an average thickness of the ink droplet formed on the recording medium is 7.5 μm. It is to be noted that the print heads 22 correspond to a liquid droplet adhesion unit.

Each irradiation unit 30 includes a driving signal generation circuit 31 and an LED light source 32. It is to be noted that the irradiation unit 30 corresponds to an electromagnetic wave irradiation device and the LED light source 32 corresponds to an irradiator. As illustrated in FIG. 1B, a irradiation unit 30 is provided for each ink type of ink and the LED light sources 32 are provided at positions separated from the print heads 22 to a downstream side in the transportation direction of the recording medium by a predetermined distance d (for example, d=50 mm). Each LED light source 32 is formed by arranging a plurality of LED light emitting elements in the all range in the width direction of the recording medium. The LED light sources 32 irradiate ultraviolet rays as electromagnetic waves entirely onto the recording medium in the width direction. An irradiation range A in which ultraviolet rays are irradiated onto the recording medium from each LED light source 32 has a predetermined width w (for example, w=80 mm) in the transportation direction. If the recording medium is transported in the transportation direction, the ink droplets discharged from each print head 22 can be located into the irradiation range A of each LED light source 32 provided at the downstream side from the print head 22 by the predetermined distance d. Therefore, polymerization on the ink droplets adhered to the recording medium is initiated and proceeds with energy of the ultraviolet rays irradiated by the LED light source 32. Further, the ink droplets discharged from each print head 22 are cured by each LED light source 32 provided at the downstream side of each print head 22.

The driving signal generation circuits 31 generate driving signals to be supplied to the LED light sources 32 based on control signals from the controller 10. A driving signal generation circuit 31 is provided for each LED light source 32 and generates a different driving signal for each LED light source 32. Accordingly, ink droplets can be cured under irradiation conditions of the ultraviolet rays, which are different depending on ink types corresponding to the print heads 22. An irradiation condition table 10*a* is recorded in the ROM (not illustrated) and the controller 10 specifies driving signals to be output to the driving signal generation circuits 31 with reference to the irradiation condition table 10*a*.

Figures 2A, 2B:
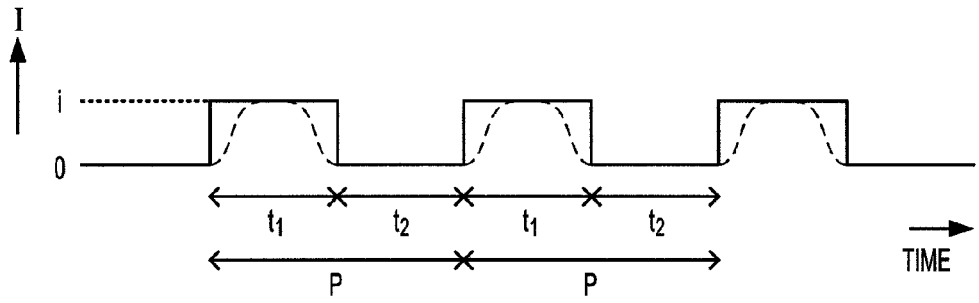
FIG. 2A is a graph illustrating a driving signal for driving the image formation apparatus.
FIG. 2B is a table illustrating an irradiation condition table.

FIG. 2A is a timing chart illustrating the driving signal. A vertical axis in FIG. 2A indicates a current value of the driving signal and irradiance of each LED light source 32 and a horizontal axis therein indicates time. The driving signal in the embodiment is a rectangular-pulse current having a current value I of either of 0 or a predetermined value i (i>0). The LED light source 32 irradiates ultraviolet rays in an irradiation time $t_1$ during which the current value I is the predetermined value i. The LED light source 32 does not irradiate ultraviolet rays in a termination time $t_2$ during which the current value I is 0. Further, a sum of a length of the irradiation time $t_1$ and a length of the termination time $t_2$ corresponds to an irradiation period P. In the embodiment, a frequency F of the irradiation period P is set to be 200 Hz. It is to be noted that the irradiation period P corresponds to a period in which ultraviolet rays are irradiated by the LED light source 32 in the irradiation time $t_1$.

On the irradiation condition table as illustrated in FIG. 2B, defines a time ratio R and the current value I of a driving signal to be output to each LED light source 32 provided for each of the ink types (W, C, M, Y, K, CL). The time ratio R is a value obtained by dividing a length of the irradiation time $t_1$ by a length of the termination time $t_2$. Note that the irradiation time $t_1$ and the termination time $t_2$ constitute the irradiation period P. The time ratio R and the predetermined value i are defined for each combination of a texture mode of a printed material and depending on whether CL is available or not. It is to be noted that the printed material does not alter an individual ink droplet and instead impacts the entire print result on which a plurality of ink droplets are superimposed one another on the recording medium. In the embodiment, a gloss mode, a semi-gloss mode, and a matte mode are prepared as the texture mode. The time ratio R for W is defined to be infinite regardless of whether CL is available or not in any of the texture modes. Note that a case where the time ratio R is infinite indicates that a length of the termination time $t_2$ is 0. That is to say, the current value I of the driving signal has no termination time $t_2$ and thus the current value I is always the predetermined value i and ultraviolet rays are continuously irradiated. The time ratio R for CL is defined only when CL is available. The ultraviolet rays are not irradiated for CL by the LED light source 32 when CL is unavailable. The time ratio R for CL is defined to be ⅓ in the gloss mode, the time ratio R for CL is defined to be 2 in the semi-gloss mode, and the time ratio R for CL is defined to be infinite in the matte mode. Further, the time ratio R for each of C, M, Y, and K is defined to be infinite regardless of the texture mode when CL is available. The time ratio R for each of C, M, Y, and K is defined to be ⅓ in the gloss mode, to be 2 in the semi-gloss mode, and to be infinite in the matte mode when CL is unavailable.

On the irradiation condition FIG. 2B, when the time ratio R is infinite, the predetermined value i of the current value I in the irradiation time $t_1$ is defined to be 0.5 A. When the time ratio R is 2, the predetermined value i of the current value I in the irradiation time $t_1$ is defined to be 0.8 A. When the time ratio R is ⅓, the predetermined value i of the current value I in the irradiation time $t_1$ is defined to be 2.5 A. That is to say, the current value I in the irradiation time $t_1$ is set to be larger as the time ratio R is lowered. Therefore, even if the irradiation time $t_1$ is shorter, energy of ultraviolet rays for curing the ink droplet can be prevented from being insufficient, meaning that it is possible to ensure that the ink droplet is cured. It is to be noted that if the predetermined value i of the current value I is set to be 0.5, 0.8, or 2.5 A, a peak irradiance in the irradiation time $t_1$ is approximately 0.7, 0.8, or 2.8 W/cm$^2$, respectively. The driving signal is ideally a rectangular-pulse current. However, as illustrated by a dashed line in FIG. 2A, an irradiance waveform of the ultraviolet rays which are actually irradiated by the LED light source 32 is a curved shape. Irradiance is changed over time while a peak in the curved shape is the peak irradiance in the irradiation time $t_1$.

If the controller 10 acquires a combination of the texture mode of the printed material and whether CL is available or not, the controller 10 specifies the time ratio R and the predetermined value i of the current value I for each ink type, which correspond to the combination, using the irradiation condition table 10*a* as a reference. Then, the controller 10 outputs a control signal for generating a driving signal in accordance with the specified time ratio R for each ink type to the corresponding driving signal generation circuit 31. That is to say, in the embodiment, since the frequency F of the irradiation period P is 200 Hz, the irradiation period P is 1/200 second. The irradiation period P is distributed based on the time ratio R so that the length of the irradiation time $t_1$ and the length of the termination time $t_2$ can be specified. For example, when the time ratio R is ⅓, the length of the irradiation time $t_1$ is (1/200)×(¼) seconds and the length of the termination time $t_2$ is (1/200)×(¾) seconds. Each driving signal generation circuit 31 corresponding to each ink type acquires a control signal for specifying the length of the irradiation time $t_1$ and the length of the termination time $t_2$ and generates a driving signal based on the control signal and outputs the driving signal to the corresponding LED light source 32. It is to be noted that the combination of the texture mode of the printed material and whether CL is available or not does not change in the middle of printing a single print job. Therefore, the time ratio R does not change in a print period of the single print job. Further, although not illustrated in the drawings, each driving signal generation circuit 31 includes a variable DC power supply circuit, an oscillation circuit, a switching circuit, and the like. The variable DC power supply circuit supplies a direct current having the current value I of the predetermined value i. The oscillation circuit generates a duty ratio corresponding to the time ratio R and a pulse wave having the frequency F. The switching circuit switches the direct current based on the pulse wave. The controller 10 corresponds to an irradiation controller and a frequency setting unit. It is to be noted that the LED light sources 32 as solid light emitting elements are used so that periodic irradiation of ultraviolet rays can be easily controlled by a current pulse.

The transportation unit 40 includes a transportation motor, a transportation roller, a motor driver, and the like (not illustrated). The transportation unit 40 transports a recording medium in the transportation direction based on a control signal from the controller 10. With this, ink droplets can be ejected towards target positions on the recording medium in the transportation direction and the width direction so as to form a two-dimensional printed image. Further, positions on the recording medium can be sequentially moved to positions just under the print heads 22 corresponding to the ink types so that ink droplets can be adhered in the order of W→C→M→Y→K→CL from the lower side in a superimposed manner. That is to say, an ink droplet of W containing a white colorant is adhered to the recording medium first. Then, ink droplets of C, M, Y, and K are adhered to the recording medium in this order. Finally, an ink droplet of transparent CL is adhered to the recording medium.

Further, an ink droplet, which has been previously adhered, is moved to the irradiation range A of the LED light source 32 corresponding to an ink type of the ink droplet so as to be cured by ultraviolet rays while an ink droplet of each ink type is adhered. Further, the ink droplet is cured while moving in the irradiation range A, and then, the recording medium is further transported so that an ink droplet of a subsequent ink type is adhered thereto in a superimposed manner. That is to say, an ink droplet of each ink type is individually irradiated with ultraviolet rays by the LED light source 32 corresponding to the ink type. It is needless to say that ink droplets which have been previously adhered are also irradiated with ultraviolet rays by the LED light sources 32 corresponding to the ink types of ink droplets which are subsequently applied. However, the ink droplets which have been previously adhered have been already cured to some degree. Therefore, influence given by the LED light sources 32 corresponding to the ink types of ink droplets which are adhered later on surface glossiness of the ink droplets which have been previously adhered can be neglected.

It is to be noted that if the ink droplet of W is formed on a lowermost layer (at the side which is the closest to the recording medium), even when the recording medium is not white, a base having flat spectral reflectance characteristics can be formed in the same manner as a case where the recording medium is white. Ink droplets containing colorants of C, M, Y and K with differing absorption spectroscopic characteristics are superimposed on the base so that various colors can be reproduced. In addition, if the ink droplet of CL is further superimposed thereon, a texture of a surface of a printed material can be adjusted by the ink droplet of CL. In the embodiment, a transportation speed of the recording medium is $v_1$ to $v_2$ (for example, $v_1$=200, $v_2$=1000 mm/sec). A length of time until an ink droplet is moved into the irradiation range A of the corresponding LED light source 32 since the ink droplet has been adhered to the recording medium is $d/v_2$ to $d/v_1$ seconds. Further, a length of time during which the ink droplet is irradiated with ultraviolet rays in the irradiation range A is $w/v_2$ to $w/v_1$ seconds.

The UI portion 50 includes a display portion which displays an image and an operation portion which captures a user operation. The UI portion 50 displays a print condition setting image for receiving a selection instruction of a texture mode of a printed material and an instruction as to whether CL is available or not on the display portion based on a control signal from the controller 10. Further, the UI portion 50 receives the selection instruction of the texture mode and the instruction whether CL is available or not for each print job by the operation portion and outputs an operation signal indicating the combination thereof to the controller 10. Accordingly, the controller 10 acquires the combination of the texture mode of the printed material and whether CL is available or not for each print job so as to specify the frequency F of the irradiation period P corresponding to the combination.

Next, a print result of a printed material which is printed on the recording medium by the above-described image formation apparatus 1 is described.

2. Print Result

Figure 3B:
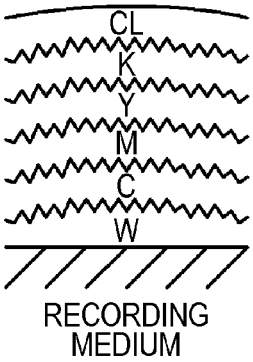

FIG. 3A is a table illustrating a relationship between the surface roughness Rq and the time ratio R and FIGS. 3B to 3G are plan views schematically showing a printed material. The surface roughness Rq is measured with the following procedures. At first, a weight c of ink droplet is adhered to a recording medium and the ink droplet is cured with ultraviolet rays having the time ratio R so as to form a measurement sample. It is to be noted that in the embodiment, the measurement sample is formed with an ink droplet of CL which is superimposed at the uppermost-surface and has large contribution to surface glossiness. A height h(x) of a surface of the measurement sample at each position x is measured over a zone (x=0 to 1) of a length l by an optical method such as a depth-of-focus method, for example. Note that the length l is desirably made to be sufficiently smaller than a size of the ink droplet in the direction parallel with the recording medium such that the height h(x) is not influenced by a curvature shape of the ink droplet itself. In addition, the height h(x) may be obtained by measuring displacement of a probe which makes contact with the surface of the measurement sample. Next, the height h(x) is substituted into the following equation (1) so as to obtain surface roughness Rq.

$$Rq = \sqrt{\frac{1}{l}\int_0^1 f(x)^2\,dx} \tag{1}$$

$$f(x) = h(x) - \frac{1}{l}\int_0^1 h(x)\,dx$$

As indicated by the Equation 1, the surface roughness Rq corresponds to a root mean square of deviation f(x) with respect to an average value of the heights h(x). As the surface roughness Rq is smaller, the surface of the measurement sample is more like a mirrored surface. Therefore, as the surface roughness Rq is decreased, surface glossiness increases. In the embodiment, surface glossiness of the measurement sample is judged to be either of glossy, semi-glossy, or matte based on the surface roughness Rq. At first, the surface glossiness of the measurement sample of which surface roughness Rq is lower than a first threshold value (5 μm) is judged to be glossy. The surface glossiness of the measurement sample of which surface roughness Rq is equal to or higher than a second threshold value (15 μm) is judged to be matte. Further, the surface glossiness of the measurement sample of which surface roughness Rq is equal to or higher than the first threshold value and lower than the second threshold value is judged to be semi-glossy.

As illustrated in FIG. 3A, the surface glossiness of the measurement sample when the time ratio R is equal to or higher than 0.2 and equal to or lower than 1 has been judged to be glossy. The surface glossiness of the measurement sample when the time ratio R is 2 has been judged to be semi-glossy. The surface glossiness of the measurement sample when the time ratio R is equal to or higher than 3 has been judged to be matte. When the time ratio R is equal to or lower than ⅙, an ink droplet has not been cured.

Figure 4A:
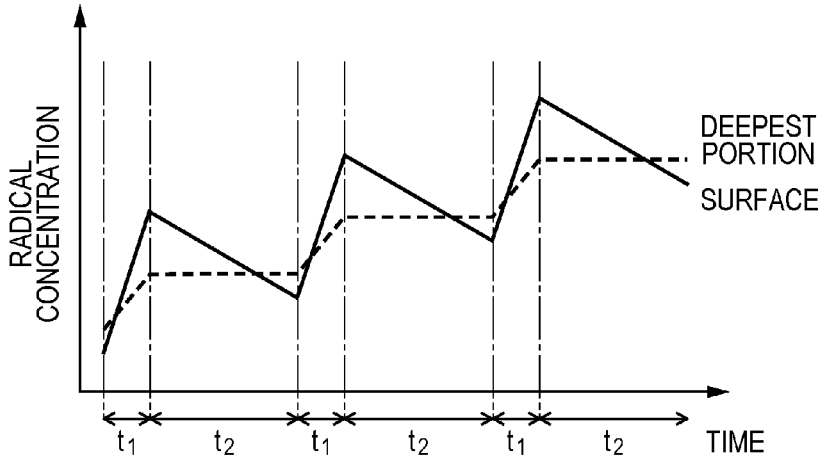
FIGS. 4A to 4C are graphs illustrating radical concentration.

FIG. 4A is a graph illustrating radical concentrations in an ink droplet when the time ratio R is ⅓. The radical concentrations on a surface of the ink droplet and a deepest portion thereof can be modeled under the following conditions. At first, the radical concentration on the deepest portion is increased by 50% of increment of the radical concentration on the surface per unit time in the irradiation time $t_1$ (FIG. 2A) during which ultraviolet rays are irradiated. This is because the ultraviolet rays decay as proceeding in the depth direction of the ink droplet so that energy of ultraviolet rays required for generation of radicals is applied from one-side to the surface. As another reason therefor, radical chain generated near the surface is more likely to terminate near the surface so that radical concentration is difficult to increase on the deepest portion of the ink droplet. On the other hand, the radical concentration on the surface is decreased per unit time by 20% of increment of the radical concentration in the irradiation time $t_1$ during which ultraviolet rays are irradiated in the irradiation time $t_2$ (FIG. 2A) during which ultraviolet rays are not irradiated. Further, oxygen is not diffused to the deepest portion of the ink droplet so that the radical concentration on the deepest portion is not influenced by oxygen inhibition in any of the irradiation time $t_1$ and the termination time $t_2$.

As illustrated in FIG. 4A, the increment of the radical concentration on the surface is larger than that on the deepest portion in the irradiation times $t_1$. Therefore, the radical concentration on the surface becomes higher than that on the deepest portion. On the other hand, only the surface is influenced by the oxygen inhibition in the termination time $t_2$ and the radical concentration on the surface is decreased. Therefore, difference of the radical concentration between the surface and the deepest portion, which has been generated in the irradiation time $t_1$, is suppressed in the termination time $t_2$. Accordingly, if the irradiation time $t_1$ and the termination time $t_2$ are repeated, the radical concentration can be increased while suppressing the difference of the radical concentration between the surface and the deepest portion. That is to say, the ink droplet can be progressively cured on the surface and the deepest portion in a balanced manner so that contraction on the surface and the deepest portion with the curing of the ink droplet can be made equivalent. Accordingly, problems where irregularities are formed on the surface due to deformation of the ink droplet and the surface glossiness is deteriorated can be prevented from occurring, thereby realizing high surface glossiness. As the difference of the radical concentration between the surface and the deepest portion is reduced, higher surface glossiness can be realized.

Further, as illustrated in FIG. 3A, it was confirmed that the surface glossiness of the ink droplet depends on the time ratio R indicating a ratio between the length of the irradiation time $t_1$ and the length of the termination time $t_2$. It is estimated that this fact is recognized because if the time ratio R is changed, relative balance among a progression degree of curing from one side to the surface of the ink droplet in the irradiation time $t_1$ and a progression degree of curing one-sided to the deepest portion of the ink droplet in the termination time $t_2$ is changed. It is estimated that if the time ratio R is lower than 0.2, the termination time $t_2$ during which ultraviolet rays are not irradiated becomes too long with respect to the oxygen diffusion rate and the oxygen inhibition also occurs on the inner portion of the ink droplet so that the entire ink droplet is uncured.

Figure 4B:
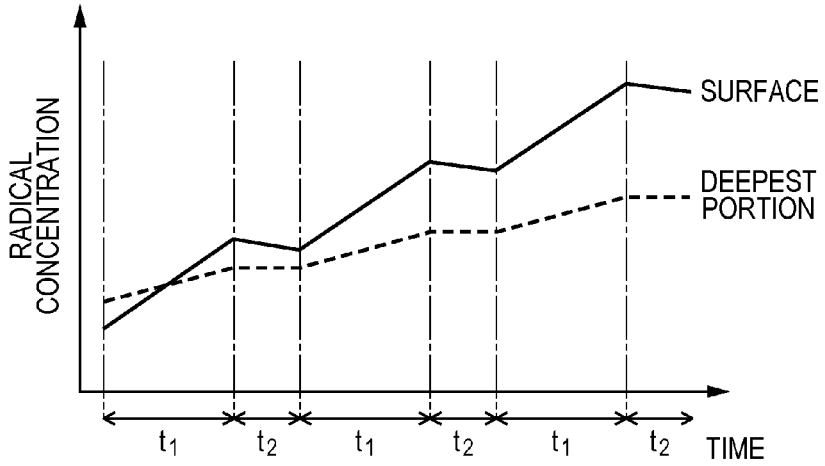

FIG. 4B is a graph illustrating radical concentration in an ink droplet when the time ratio R is 2. When the time ratio R is 2, the progression degree of curing from one side to the surface of the ink droplet in the irradiation time $t_1$ is too large with respect to the progression degree of the curing one-sided to the deepest portion of the ink droplet in the termination time $t_2$. Therefore, in this case, the difference of the radical concentration between the surface and the deepest portion is larger in comparison with the case where the time ratio R is ⅓.

Accordingly, deformation is generated between the surface and the deepest portion of the ink droplet so that the surface glossiness of the ink droplet is semi-glossy.

Figure 4C:
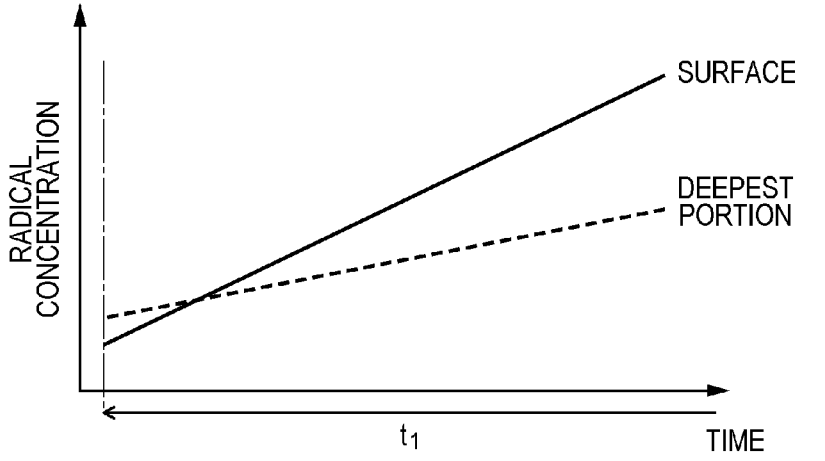

FIG. 4C is a graph illustrating radical concentration in an ink droplet when the time ratio R is infinite (continuous irradiation). When the ink droplet is continuously irradiated, the progression degree of curing one-sided to the surface of the ink droplet in the irradiation time $t_1$ is too large with respect to the progression degree of the curing from one side to the deepest portion of the ink droplet in the termination time $t_2$. Therefore, in this case, the difference of the radical concentration between the surface and the deepest portion is larger in comparison with the case where the time ratio R is 2. Accordingly, larger deformation is generated between the surface and the deepest portion of the ink droplet in comparison with the case where the time ratio R is 2 so that the surface glossiness of the ink droplet is matte. It is to be noted that in the embodiment, as the time ratio R is decreased, the predetermined value i of the current value I of the driving signal is larger. Therefore, even when the time ratio R is ⅓, radical concentration which is equivalent to that in cases where the time ratio R is 2 or infinite can be realized, thereby preventing the ink droplet from being uncured.

Figure 3D:
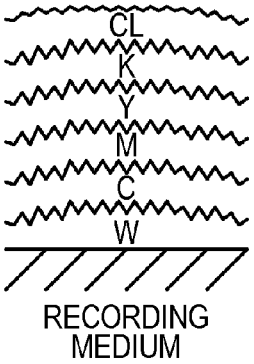
Figure 3F:
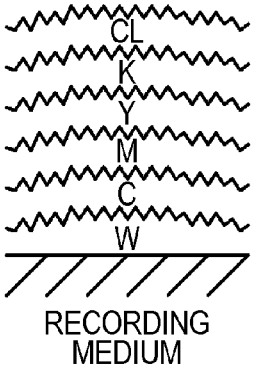
Figure 3C:
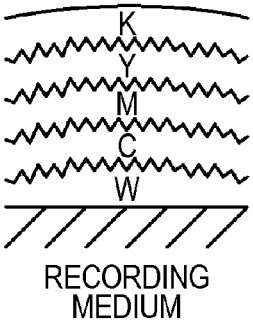
Figure 3E:
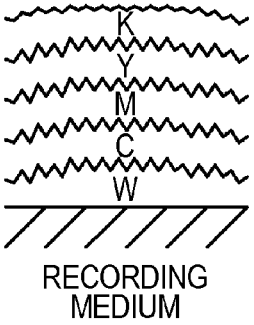
Figure 3G:
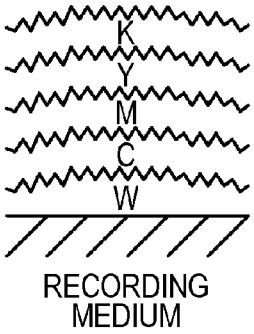

FIGS. 3B to 3G are plan views schematically illustrating a printed material (orthogonally cut cross section of a recording medium (hatching)) for each combination of the texture mode and whether CL is available or not. FIGS. 3B, 3D, and 3F illustrate a printed material when CL is available and FIGS. 3C, 3E, and 3G illustrate a printed material when CL is unavailable. Further, FIGS. 3B and 3C illustrate a printed material when the texture mode is the gloss mode, FIGS. 3D and 3E illustrate a printed material when the texture mode is the semi-gloss mode, and FIGS. 3F and 3G illustrate a printed material when the texture mode is the matte mode.

On the irradiation condition table 10*a* as illustrated in FIG. 2B, the time ratio R for W is infinite regardless of the texture mode and whether CL is available or not and surface glossiness of the ink droplet of W is made low. With this, scattered reflection on the surface is accelerated so that whiteness can be enhanced. Further, as illustrated in FIGS. 3B to 3G, considering that ink droplets of other ink types are superimposed on and bonded to the ink droplet of W, the surface glossiness of the ink droplet of W is made low. As the surface glossiness of the ink droplet is lowered, that is, as the surface roughness Rq is higher, a bonding area between the ink droplets which are superimposed one another in the thickness direction is increased so that high bonding strength can be obtained. Further, the ink droplet of W is formed at the side of the recording medium which is the farthest from the surface and contribution thereof to the texture of the surface is reduced. Therefore, there are no problems even when the surface glossiness of the ink droplet of W is decreased regardless of the texture mode.

On the other hand, when CL is available as illustrated in FIGS. 3B, 3D, and 3F, since the ink droplet of CL is formed on an uppermost surface, contribution thereof to the texture of the printed material is the largest. Accordingly, on the irradiation condition table 10*a* as illustrated in FIG. 2B, when the texture mode is the gloss mode, the time ratio R for CL is ⅓. When the texture mode is the semi-gloss mode, the time ratio R for CL is 2. Further, when the texture mode is the matte mode, the time ratio R for CL is infinite. With this, when CL is available, the printed material having surface glossiness desired by a user can be obtained. It is to be noted that when CL is available, the time ratio R for each of W, C, M, Y, and K is infinite in order to improve the bonding strength of each ink droplet and the ink droplet at an upper layer. When CL is available, since influence given by the ink droplets of W, C, M, Y, and K on the texture of the surface is small, there arises no problem even when the bonding strength is valued.

In contrast, when CL is unavailable, as illustrated in FIGS. 3C, 3E, and 3G, influence given by the ink droplets of C, M, Y, and K on the texture of the surface is large. Accordingly, on the irradiation condition table 10*a* as illustrated in FIG. 2B, when CL is unavailable, the time ratio R for each of C, M, Y, and K is defined to be a value in accordance with the texture mode. That is to say, when the texture mode is the gloss mode, the time ratio R for each of C, M, Y, and K is ⅓. When the texture mode is the semi-gloss mode, the time ratio R of the irradiation period P for each of C, M, Y, and K is 2. Further, when the texture mode is the matte mode, the time ratio R for each of C, M, Y, and K is infinite.

As described above, if the time ratio R is set to be a value of equal to or higher than 0.2 and equal to or lower than 2, higher surface glossiness of the ink droplet can be obtained in comparison with a case where ultraviolet rays are continuously irradiated. Further, if the time ratio R is switched in accordance with the selected and instructed texture mode, a printed material having desired surface glossiness can be obtained. In addition, if the time ratio R is set depending on an ink type, surface glossiness (surface roughness) of an ink droplet, which is suitable to the function of ink and an adherence order of the ink droplet, can be realized.

3. Variations

In FIG. 3A, relationships between the time ratio R and the surface glossiness of the ink droplet when an average thickness of the ink droplet is 12.5, and 17.5 μm in addition to 7.5 μm are indicated. It can be confirmed that as the average thickness increases, an upper limit value of the time ratio R at which the surface glossiness of the ink droplet is glossy or semi-glossy is lowered. Therefore, when the image formation apparatus 1 can switch a weight of the ink droplet per ejection, or the like, as the average thickness of the ink droplet is increased, the upper limit value of the time ratio R for making the surface glossiness of the ink droplet be glossy or semi-glossy may be reduced. In addition, the time ratio R may be equal to or higher than ⅕ and equal to or lower than ⅓ such that the surface glossiness is glossy regardless of the average thickness in a range as illustrated in FIG. 3A. In the same manner, the time ratio R may be equal to or higher than 3 such that the surface glossiness is matte regardless of the average thickness in a range as illustrated in FIG. 3A.

In the above embodiment, the time ratio R is set in accordance with each ink type. However, the time ratio R may be set uniformly for all of the ink types. In this case, if the time ratio R is set to be a value of equal to or higher than 0.2 and equal to or lower than 2, higher surface glossiness can be also obtained in comparison with a case where ultraviolet rays are continuously irradiated. It is sufficient that the time ratio R is set to be a value in a range of equal to or higher than 0.2 and equal to or lower than 2 and a time ratio R other than the time ratios R defined on the irradiation condition table 10*a* in the above embodiment may be set, of course. Further, in the above embodiment, the time ratio R is defined on the irradiation condition table 10*a*. However, it is sufficient that the time ratio R is set to be a value in a range of equal to or higher than 0.2 and equal to or lower than 2 as a result. Therefore, other indications (for example, reciprocal of the time ratio R, and the length of the irradiation time $t_1$ and the length of the termination time $t_2$ themselves) and the like from which the time ratio R can be derived uniquely may be defined in the irradiation condition table 10*a*.

Further, the invention may be applied to a serial printer in which ink droplets are discharged while a carriage (print head) moves in a main scanning direction perpendicular to a transportation direction of a recording medium. In this case, an irradiator may be provided on the carriage or may be provided separately from the carriage. It is needless to say that not only in an image formation apparatus which uses a plurality of types of inks but also in an image formation apparatus which uses a single color ink, a monochrome print image having high surface glossiness can be also obtained by setting the time ratio R. In addition, in the above embodiment, the time ratio R when ultraviolet rays are irradiated is set. However, the time ratio R when other electromagnetic waves such as visible light and microwave are irradiated may be set. With this, a printed material having high surface glossiness can be also obtained with ink droplets which cure with other electromagnetic waves. It is needless to say that a generation source of the electromagnetic waves is not limited to an LED and may be a rare gas light source or the like.

What is claimed is:

1. An electromagnetic wave irradiation device comprising:

an irradiator which irradiates electromagnetic waves onto a liquid droplet which has been adhered to a recording medium;

an irradiation controller which controls the irradiator such that the irradiator irradiates the electromagnetic waves periodically such that a frequency of an irradiation period in which the electromagnetic waves are irradiated by the irradiator is a predetermined frequency;

a time setting unit which sets a time ratio obtained by dividing a length of an irradiation time during which the electromagnetic waves are irradiated by the irradiator in the irradiation period by a length of a termination time during which the electromagnetic waves are not irradiated by the irradiator in the irradiation period, the time ratio including a first time ratio and a second time ratio that is higher than the first time ratio; and a mode setting portion which sets a texture mode of the recording medium, the texture mode including a first texture mode and a second texture mode that is lower glossiness than the first texture mode;

wherein the time setting unit sets the first time ratio when the mode setting portion sets the first texture mode, and the time setting unit sets the second time ratio when the mode setting portion sets the second texture mode.

2. The electromagnetic wave irradiation device according to claim 1, wherein the irradiation controller makes intensity of the electromagnetic waves to be irradiated by the irradiator larger as the time ratio is lower.

3. The electromagnetic wave irradiation device according to claim 1, wherein an average thickness of the liquid droplet on the recording medium is 7.5 μm.

4. The electromagnetic wave irradiation device according to claim 1, wherein the predetermined frequency is 200 Hz.

5. The electromagnetic wave irradiation device according to claim 1, wherein the liquid droplet is a black ink.

6. An image formation apparatus comprising:

a liquid droplet adhesion unit which makes the liquid droplet adhere to a recording medium;

an irradiator which irradiates electromagnetic waves onto the liquid droplet which has been adhered to the recording medium;

an irradiation controller which controls the irradiator such that the irradiator irradiates the electromagnetic waves periodically such that a frequency of an irradiation period in which the electromagnetic waves are irradiated by the irradiator is a predetermined frequency;

a time setting unit which sets a time ratio obtained by dividing a length of an irradiation time during which the electromagnetic waves are irradiated by the irradiator in the irradiation period by a length of a termination time during which the electromagnetic waves are not irradiated by the irradiator in the irradiation period, the time ratio including a first time ratio and a second time ratio that is higher than the first time ratio; and a mode setting portion which sets a texture mode of the recording medium, the texture mode including a first texture mode and a second texture mode that is lower glossiness than the first texture mode;

wherein the time setting unit sets the first time ratio when the mode setting portion sets the first texture mode, and the time setting unit sets the second time ratio when the mode setting portion sets the second texture mode.

7. The image formation apparatus according to claim 6, wherein the irradiation controller makes intensity of the electromagnetic waves to be irradiated by the irradiator larger as the time ratio is lower.

8. The image formation apparatus according to claim 6, wherein an average thickness of the liquid droplet on the recording medium is 7.5 μm.

9. The image formation apparatus according to claim 6, wherein the predetermined frequency is 200 Hz.

10. The image formation apparatus according to claim 6, wherein the liquid droplet is a black ink.

* * * * *